United States Patent [19]

Suenaga

[11] 4,181,058

[45] Jan. 1, 1980

[54] ELECTRICAL STRING-INSTRUMENT

[75] Inventor: Noboru Suenaga, Osaka, Japan

[73] Assignee: Roland Corporation, Osaka, Japan

[21] Appl. No.: 805,353

[22] Filed: Jun. 10, 1977

[30] Foreign Application Priority Data

Jun. 10, 1976 [JP] Japan ..... 51/68543

[51] Int. Cl.[2] ..... G10D 5/00; G10H 3/08

[52] U.S. Cl. ..... 84/1.16; 84/DIG. 30

[58] Field of Search ..... 84/1.01, 1.15, 1.16, 84/DIG. 30

[56] References Cited

U.S. PATENT DOCUMENTS 2,293,806 8/1942 Dawson ..... 84/1.16

3,290,424 12/1966 Fender ..... 84/1.16

3,722,113 6/1973 Cohen ..... 84/1.16

*Primary Examiner*—Edith S. Jackmon

*Attorney, Agent, or Firm*—Marshall & Yeasting

[57] ABSTRACT

An electrical string-instrument having a plurality of conductive strings, a support member stretching the strings, electromechanical transducers respectively corresponding to the strings, magnetic field generating means for generating a constant magnetic field to cover therewith the strings, an electrical circuit for producing feedback signals from the outputs of the electromechanical transducers, and feedback signal supply means for supplying the feedback signals to flow feedback currents in the strings, and vibrate continuously in cooperation with the magnetic field.

3 Claims, 7 Drawing Figures

F3
F4
F2
F5
F1
F6
10
B1
A1
B2
A2
B3
A3
A4
A5
A6
41
47
48
MO
44
43
45
46
E0
32
33
31
34
C1
C2
C3
C4
C5
C6
I1
I2
I3
I4
I5
I6
11
8
E1
E2
E3
E4
E5
E6
G1
G2
G3
G4
G5
G6
H1
H2
H3
H4
H5
H6
J1
J2
J3
J4
J5
J6
M1
M2
M3
M4
M5
M6
K1
K2
K3
K4
K5
K6

F3
F4
F2
F5
F1
F6
10
B1
A1
B2
A2
B3
A3
A4
A5
A6
33
32
34
31
C'
C1
C2
C3
C4
C5
C6
11
I1
I2
I3
I4
I5
I6
8
E'
61
63
62
65
EM
66
47
MO
48
Q3
Q2
Q1
Q6
Q5
Q4
44
43
41
45
46
EO
E1
E2
E3
E4
E5
E6
G1
G2
G3
G4
G5
G6
H1
H2
H3
H4
H5
H6
J1
J2
J3
J4
J5
J6
M1
M2
M3
M4
M5
M6
K1
K2
K3
K4
K5
K6

ELECTRICAL STRING-INSTRUMENT

BACKGROUND OF THE INVENTION

1. Field of the Invention

This invention relates to an electrical string-instrument.

2. Description of the Prior Art

In recent years, the so-called electrical guitar has widely been used as an electrical string-instrument. The electrical guitar has six strings and a support member having a major surface which includes a string receiving surface and on which the strings are stretched in substantially the same plane in parallel relation to one another and in opposing relation to the string receiving surface. On the string receiving surface of the support member, a plurality of frets which extend substantially at right angles to the strings, are sequentially provided in the direction of extension of the strings. Further, in the area other than the string receiving surface in the area opposite to the strings, there are provided electromechanical transducer means for converting mechanical vibrations of the strings into corresponding electrical signals.

When playing the guitar, the player touches a desired one or more of the strings while pressing or not pressing them against the string receiving surface with his fingers. A sound signal which is obtained from the electromechanical transducer means when picking the guitar without pressing the string against the string receiving surface, is called an open-string sound signal. In the case of pressing the string against the string receiving surface with the finger, the sound signal derived from the electromechanical transducer means has a higher frequency than the abovesaid open-string sound signal. The reason is that the string is urged against the fret nearest the pressed position on the side of the electromechanical transducer means with respect to the position where the string is pressed. In the case of picking an ordinary electrical guitar, the string picked by the finger performs a damped oscillation. Accordingly, the amplitude of the sound signal derived from the electromechanical transducer means is attenuated with the lapse of time. Therefore, it is impossible with the ordinary electrical guitar to obtain a sound signal having a sustain effect.

Heretofore, attempts have been made to obtain the sound signal having the sustain effect with the electrical guitar. However, no satisfactory electrical guitar has been obtained for the reasons that the electrical guitar becomes bulky, and that the sound signal obtained from the electromechanical transducer means is unstable.

SUMMARY OF THE INVENTION

Accordingly, a primary object of this invention is to provide a novel electrical string-instrument which is simple in construction but capable of stably producing an electrical sound signal having the sustain effect.

Another object of this invention is to provide a novel electrical guitar which is simple in construction but capable of stably producing an electrical sound signal having the sustain effect.

Other objects, features and advantages of this invention will become more fully apparent from the following description taken in conjunction with the accompanying drawings.

DESCRIPTION OF THE PREFERRED EMBODIMENTS

Figure 1:
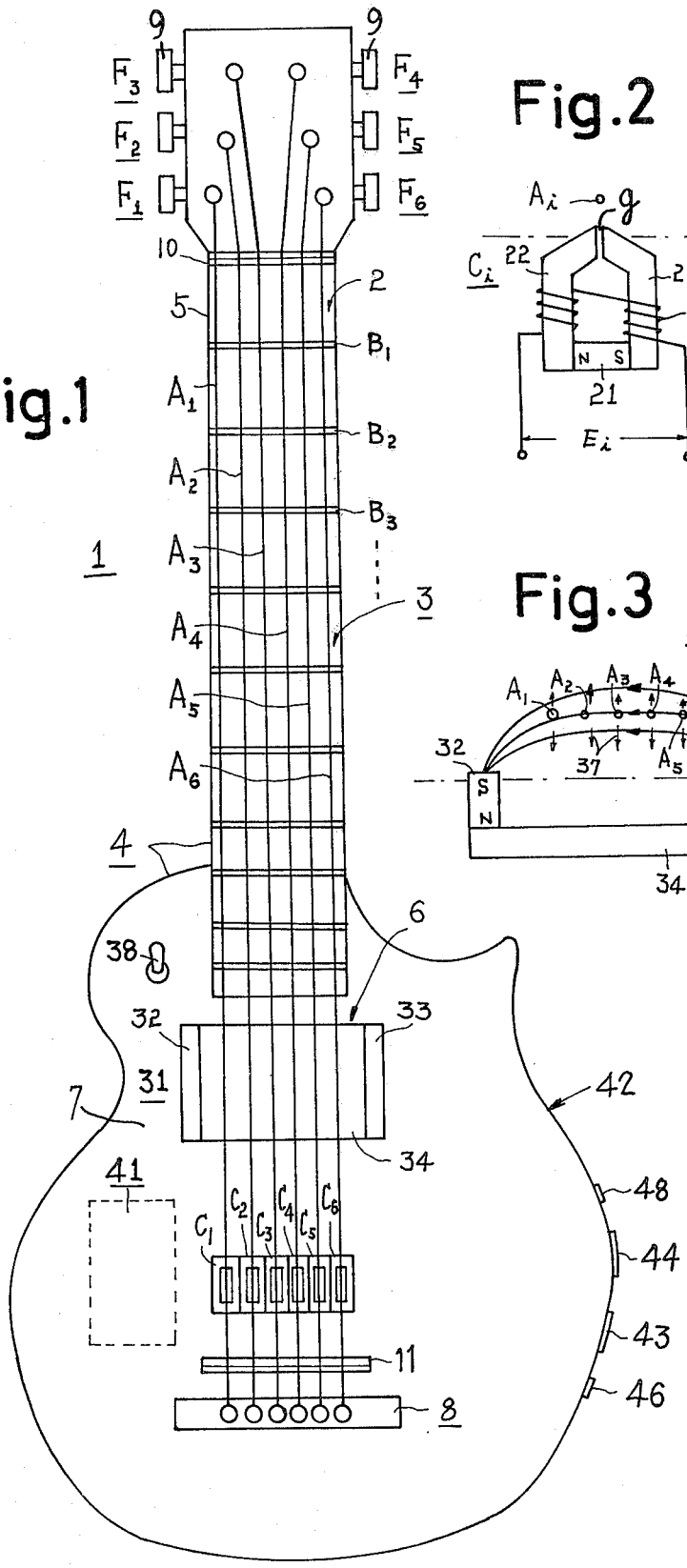
FIG. 1 is a front view schematically illustrating an embodiment of this invention as being applied to an electrical guitar.

In FIG. 1, reference numeral 1 indicates generally an example of an electrical guitar of this invention, which has six conductive and magnetic strings $A_1, A_2, \ldots A_6$ and a nonconductive support member 4 which has a major surface 3 including a string receiving surface 2 and on which the strings $A_1$ to $A_6$ are stretched in substantially the same plane in parallel relation to one another and in opposing relation to the string receiving surface 2.

On the string receiving surface 2 of the support member 4, a plurality of conductive frets $B_1, B_2, \ldots$, which extend substantially at right angles to the direction of extension of the strings $A_1$ to $A_6$, are sequentially disposed in the direction of extension of the strings $A_1$ to $A_6$. That part of the support member 4 which has the string receiving surface 2 is referred to as a neck portion 5. The part which includes an area 6 of the major surface 3 of the support member 4 except the string receiving surface 2 in the area opposite to the strings $A_1$ to $A_6$, is called a body 7. The neck portion 5 extends upwardly from the body 7. At the lower side of the area 6 of the body 7, there are disposed fixing means 8, to which the strings $A_1$ to $A_6$ are fixed at one end. The other ends of the strings $A_1$ to $A_6$ are respectively retained at individual fixing means $F_1, F_2, \ldots F_6$ which are provided on the upper end portion of the neck portion 6 and each have a screw 9 for adjusting the tension of the string. A little above the fixing means 8 on the area 6 of the body 7, a fret 11 is provided for bridging the strings $A_1$ to $A_6$. Disposed slightly below the fixing means $F_1$ to $F_6$ on the neck portion 5 is a fret 10 for similarly bridging the strings $A_1$ to $A_6$. The strings $A_1$ to $A_6$ are held by the frets 11 and 10, by which they are stretched to extend on the support member 4 in substantially the same plane in parallel relation to each other and in opposing relation to the string receiving surface 2.

Figure 2:
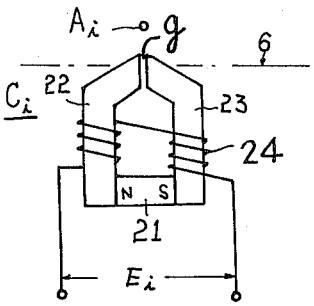
FIG. 2 is a cross-sectional view schematically showing an example of an electromechanical transducer for use in the electrical guitar depicted in FIG. 1.

At lower positions in the area 6 of the body 7, electromechanical transducer means $C_1, C_2, \ldots C_6$ for converting mechanical vibrations of the strings $A_1, A_2, \ldots A_6$ into corresponding electrical signals $E_1, E_2, \ldots E_6$ are sequentially disposed in the direction of array of the strings $A_1$ to $A_6$ in opposing relation thereto. An example of each of the electromechanical transducer means $C_1$ to $C_6$ is such a magnetic head type one as shown in FIG. 2 which comprises a bar or plate-like magnet 21, a magnetic core 22 coupled at one end with one end of the magnet 21, another magnetic core 23 coupled at one end with the other end of the magnet 21 and having the other end disposed opposite to the other end of the magnetic core 22 to form an air gap g, and a coil 24 composed of two parts respectively wound on the cores 22 and 23. The electromechanical transducer means Ci (i=1, 2, . . . 6) is disposed opposite to the string Ai so that the widthwise direction of the air gap g may be substantially perpendicular to the direction of extension of the string Ai. Accordingly, when the string Ai is vibrated by being touched at the portion opposing the surface of the area 6, a vibration voltage, which corresponds to the components of vibration in the direction perpendicular to the surface of the area 6, is obtained as an electrical sound signal Ei across the coil 24 of the magnetic head type means Ci.

Figure 3:
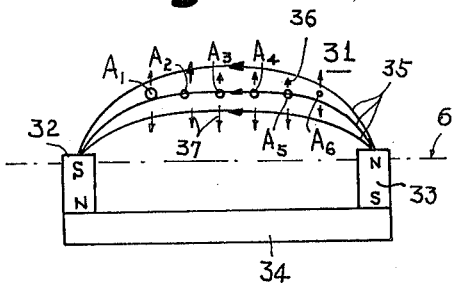
FIG. 3 is a cross-sectional view schematically showing an example of magnetic field generating means for use in the electrical guitar shown in FIG. 1.

At the upper position in the area 6 of the body 7, there is disposed magnetic field generating means 31 which sets up a constant magnetic field to cover the strings $A_1$ to $A_6$. An example of the magnetic field generating means 31 is such, for example, as depicted in FIG. 3, which comprises two bar or plate-shaped magnets 32 and 33 disposed on both sides of an area corresponding to the area of array of the strings $A_1$ to $A_6$ in their widthwise direction, and a magnetic core 34 extending between one end of the magnet 32 and one end of the magnet 33. In this case, the one end of the magnet 32 coupled with the core 34 forms the magnetic north pole and the other end the magnetic south pole. Further, the one end of the magnet 33 coupled with the core 34 forms the magnetic south pole and the other end the magnetic north pole. Accordingly, at the upper position in the area 6 of the body 7, there is generated a magnetic field 35 emanating from the magnetic north pole of the magnet 33 to the magnetic south pole of the magnet 32 in a direction perpendicular to the direction of extension of the strings $A_1$ to $A_6$ to cross them. Therefore, if a current flows in the string Ai, the string Ai is moved by the Fleming's law in the direction perpendicular to the area 6 in accordance with the direction of the current flowing in the string Ai, as indicated by the arrows 36 and 37.

Figure 4:
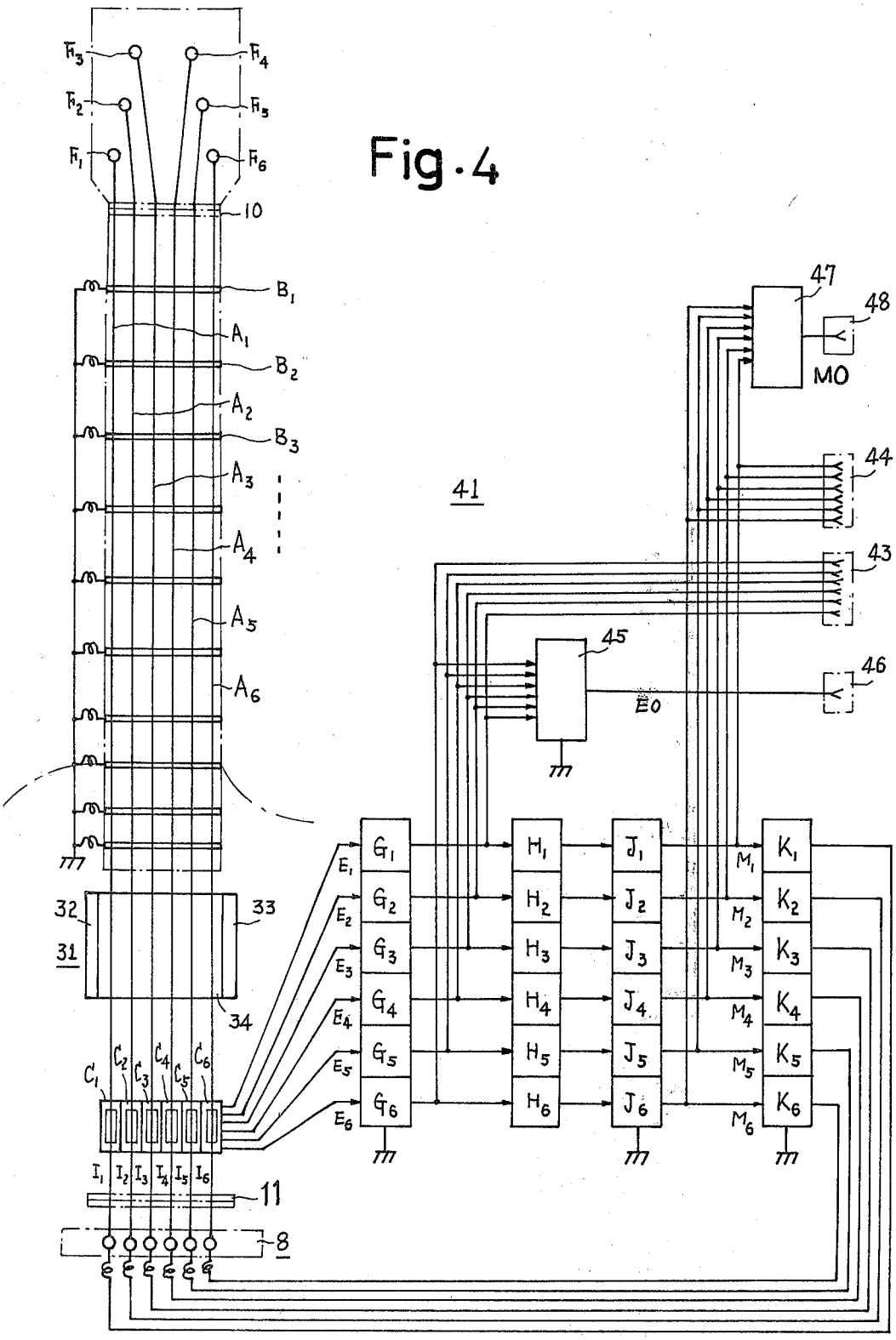
FIG. 4 is a schematic diagram illustrating an example of the electrical construction of the electrical guitar shown in FIG. 1.

The body 7 has disposed therein an electrical circuit 41 indicated by the broken-line block in FIG. 1. In the electrical circuit 41, as shown in FIG. 4, the electrical sound signals $E_1, E_2, \ldots E_6$ respectively derived from the coils 24 of the electromechanical transducer means $C_1, C_2, \ldots C_6$ are amplified by preamplifiers $G_1, G_2, \ldots G_6$, and then supplied to threshold circuits $J_1, J_2, \ldots J_6$ through ganged switches $H_1, H_2, \ldots H_6$, respectively, by which signals, shaped into rectangular waveforms which are "1" or "0" in the binary representation depending upon whether the electrical sound signals $E_1, E_2, \ldots E_6$ are above or below predetermined levels, respectively, are obtained as feedback signals $M_1, M_2, \ldots M_6$. Then, the signals $M_1, M_2, \ldots M_6$ thus obtained are amplified by driving amplifiers $K_1, K_2, \ldots K_6$, respectively. An actuator 38 for the ganged switches $H_1$ to $H_6$ is provided on the major surface 3 in the area on the body 7.

The outputs of the driving amplifiers $K_1, K_2, \ldots K_6$ of the electrical circuit 41 are respectively connected at one end to the ends of the strings $A_1, A_2, \ldots A_6$ on the side of the fixing means 8, and grounded at the other end. Also, the abovesaid conductive frets $B_1, B_2, \ldots$ are grounded. Accordingly, when the string Ai is picked by one finger at the position opposite to the area 6 while being urged by another finger against the string receiving surface 2 and engaged with the fret Bj (j=1, 2, . . . ), the feedback current Ii based on an amplified feedback signal Mi derived from the driving amplifier Ki flows in the string Ai as long as the string Ai is pressed against the string receiving surface 2 and engaged with the fret Bj. Consequently, if the polarity of the feedback signal Mi is selected such that the string Ai may be moved by the Fleming's law in the same direction as the direction of vibration of the string Ai when touched, when the string Ai has once been touched by finger while being urged against the string receiving surface 2 and engaged with the fret Bj, the string Ai continues to vibrate as long as it is pressed against the string receiving surface 2 and engaged with the fret Bj. Accordingly, the sound signal Ei from the electromechanical transducer Ci or preamplifier Gi is obtained as a sound signal corresponding to the continuous vibration of the string Ai. Such a signal is called a sound signal having the sustain effect. Further, when released from the abovesaid pressed state, the string Ai immediately starts to perform damped vibration. As a result of this, the sound signal Ei from the electromechanical transducer Ci or preamplifier Gi is obtained as a damped sound signal. The sound signals $E_1$ to $E_6$ derived from the preamplifiers $G_1$ to $G_6$ are led out as one kind of output from the electrical circuit 41 to the outside through a multi-jack 43 disposed on the side 42 of the body 7. Further, the sound signals $M_1$ to $M_6$ having rectangular waveforms, derived from the threshold circuits $J_1$ to $J_6$, are similarly led out as the other kind of output from the electrical circuit 41 to the outside through a multi-jack 44 disposed on the side 42 of the body 7.

Further, the electrical circuit 41 is designed so that the amplified electrical sound signals $E_1$ to $E_6$ from the preamplifiers $G_1$ to $G_6$ are mixed by the mixing circuit 45 to derive therefrom a signal EO into which the electrical signals $E_1$ to $E_6$ are combined. The electrical signal EO thus obtained from the mixing circuit 45 is led out as another kind of output from the electrical circuit 41 to the outside through a jack 46 provided on the side 42 of the body 7. Accordingly, if the electrical guitar of this invention is picked in the state in which the abovesaid switches $H_1$ to $H_6$ are held in the off state by the aforementioned actuator 38, the feedback signal $M_1$ to $M_6$ are not derived from the threshold circuits $J_1$ to $J_6$, so that the currents $I_1$ to $I_6$ do not flow in the strings $A_1$ to $A_6$. As a result of this, the electrical sound signals $E_1$ to $E_6$ from the electromechanical transducer means $C_1$ to $C_6$ are not the sound signals corresponding to the abovesaid continuous vibration of the string, so that the signal EO led to the outside through the jack 46 is obtained as a sound signal of the same mode as a sound signal obtained with an ordinary electrical guitar. However, when the electrical guitar of this invention is picked with all or some of the strings $A_1$ to $A_6$ urged by fingers against the string receiving surface 2 in the state in which the switches $H_1$ to $H_6$ are held in the on state by the actuator 38, electrical sound signals derived from all or some of the electromechanical transducer means $C_1$ to $C_6$ corresponding to the strings pressed against the string receiving surface 2 in this case are obtained as sound signals corresponding to the aforesaid continuous vibration, so that the signal EO led out to the outside through the jack 46 is a sound signal having the sustain effect. Further, the electrical circuit 41 has a mixer 47 which is adapted such that the feedback signals $M_1$ to $M_6$ of the rectangular waveform, derived from the threshold circuits $J_1$ to $J_6$ are mixed together to provide a composite signal MO. The signal MO thus obtained from the mixer 47 is led out as another kind of output from the electrical circuit 41 to the outside through a jack 48. Accordingly, when the guitar is played in the state that the switches $H_1$ to $H_6$ are closed by the operation of the actuator 38, the sound signal MO of rectangular waveform having the sustain effect is led out to the outside.

Figure 5:
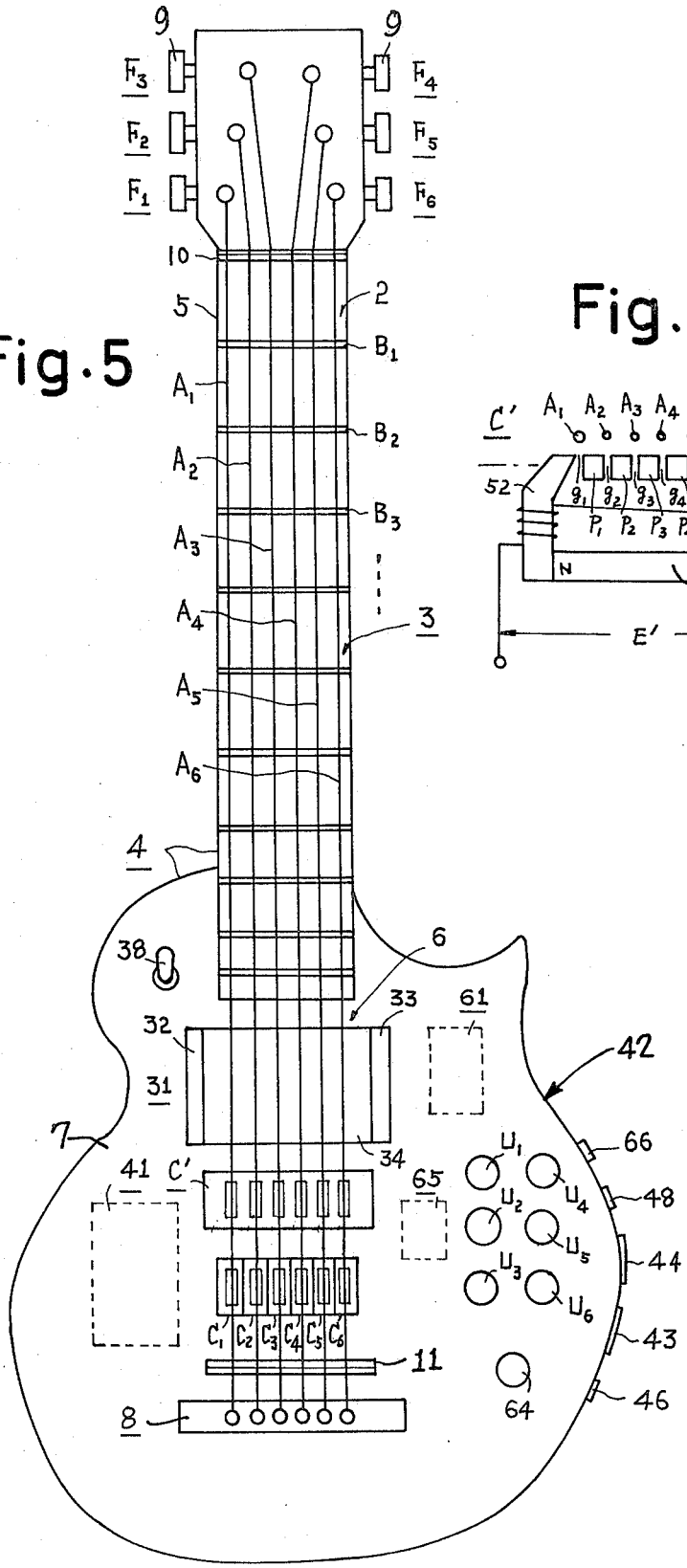
FIG. 5 is a schematic front view showing another example of the electrical guitar of this invention.
Figure 6:
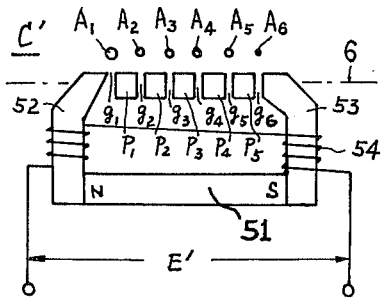
FIG. 6 is a schematic cross-sectional view illustrating an example of a common electromechanical transducer for use in the electrical guitar depicted in FIG. 5.
Figure 7:
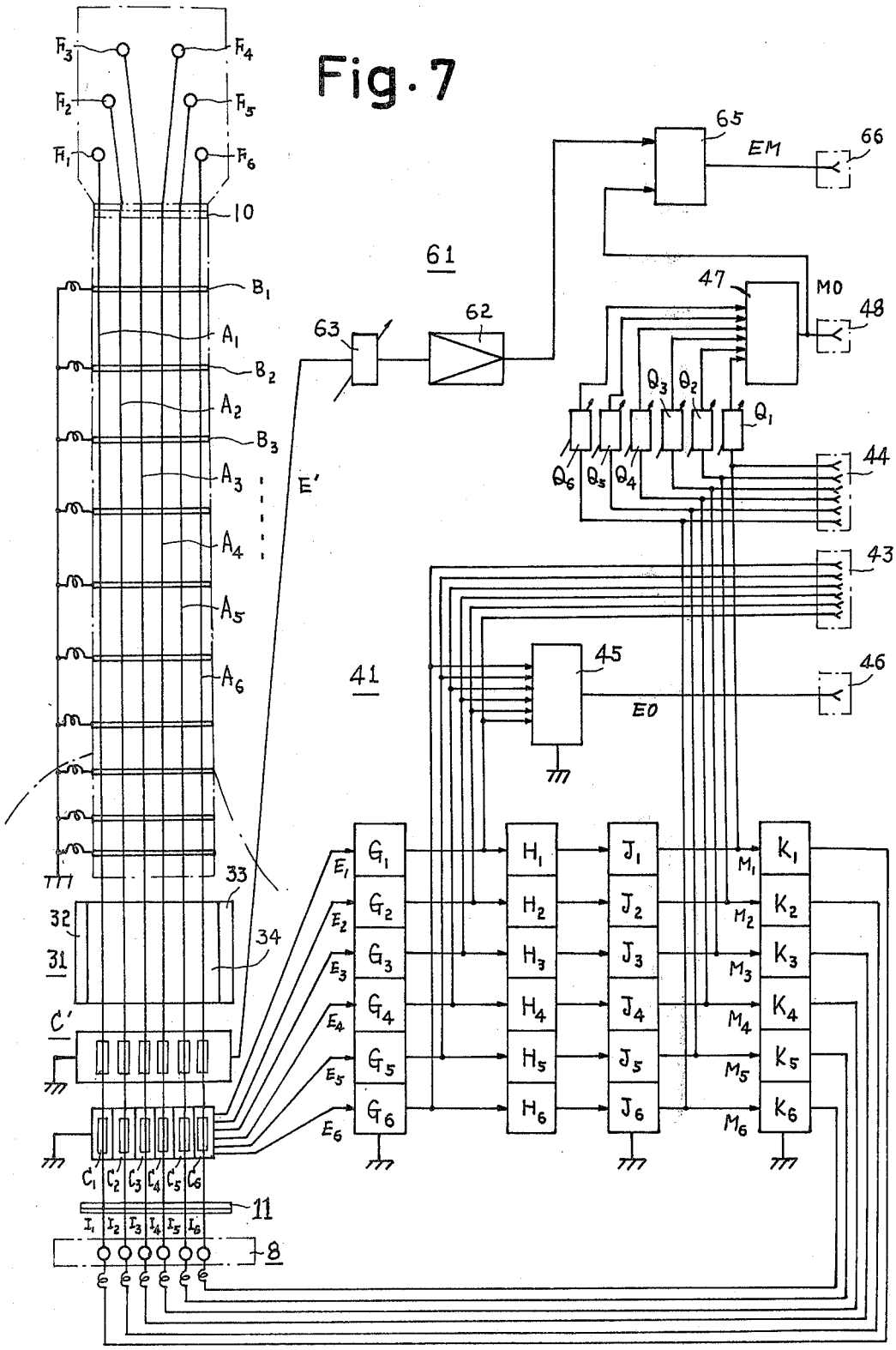
FIG. 7 is a schematic diagram showing an example of the electrical construction of the electrical guitar depicted in FIG. 5.

FIGS. 5, 6 and 7 illustrate other embodiments of the electrical guitar of this invention. In FIGS. 5, 6 and 7, the parts corresponding to those in FIGS. 1 to 4 are identified by the same reference numerals and no detailed description will be repeated.

At the center of the area 6 of the body 7, there is disposed opposite to the strings $A_1$ to $A_6$ electromechanical transducer means C' which converts mechanical vibrations of the strings $A_1$ to $A_6$ into a composite signal E' of electrical signals corresponding to the vibrations and which is common to the strings $A_1$ to $A_6$. The electromechanical transducer means C' is, for instance, such a multigap magnetic head type one as shown in FIG. 6, which is composed of a bar or plate-like magnet 51, a magnetic core 52 coupled at one end with the magnet 51, another magnetic core 53 coupled at one end with the other end of the magnet 51 and having the other end disposed opposite to the magnetic core 52, magnetic core elements $p_1, p_2, \ldots p_5$ disposed between the other ends of the magnetic cores 52 and 53 to form airgaps $g_1, g_2, \ldots g_6$, and a coil 54 composed of two parts respectively wound on the magnetic cores 52 and 53. The electromechanical transducer C' is disposed opposite to the strings $A_1, A_2, \ldots A_6$ so that the widthwise directions of the gaps $g_1, g_2, \ldots g_6$ may be substantially perpendicular to the direction of extension of the strings $A_1, A_2, \ldots A_6$. Accordingly, when the string Ai is vibrated by touching, a vibration voltage which corresponds to the components of vibration in the direction perpendicular to the surface of the area 6 is obtained as the electrical sound signal E' across the coil 54 of the magnetic head type means C'. Further, when some or all of the strings $A_1$ to $A_6$ are simultaneously vibrated by touching, a voltage that vibration voltages corresponding to the components of the vibrations in the direction perpendicular to the major surface 3 is obtained as the electrical sound signal E'.

The other electrical circuit 61 is disposed in the body 7 and adapted so that the electrical sound signal E' derived from the coil 54 of the electromechanical transducer means C' is supplied to an amplifier 62 through a volume 63, and then amplified by the amplifier 62, as shown in FIG. 7. An actuator 64 for the volume 63 is disposed on the surface of the body 7, as illustrated in FIG. 5.

Further, the body 7 has incorporated therein a circuit 65 for combining the electrical sound signal MO from the mixer 47 of the electrical circuit 41 with the amplified electrical sound signal E' from the amplifier 62 of the electrical circuit 61 to provide a composite signal EM. The composite signal EM is led out to the outside through a jack 66 provided on the side 42 of the body 7. In this case, however, volumes $Q_1$ to $Q_6$ are provided on the input side of the mixer 47 in the electrical circuit 41. Actuators $U_1$ to $U_6$ for the volumes $Q_1$ to $Q_6$ are disposed on the surface of the body 7, as shown in FIG. 5. Accordingly, where the switches $H_1$ to $H_6$ of the electrical circuit 41 are closed by their actuator 38, the signal EM is obtained as a composite sound signal that the rectangular sound signals $M_1$ to $M_6$ having the sustain effect and adjusted in amplitude, which are led out to the outside through the jack 66, and the sound signal E' having the sustain effect are combined with each other. However, in the case where the switches $H_1$ to $H_6$ are not closed, the signal EM led out to the outside through the jack 66 is obtained as a signal similar to that obtainable with an ordinary electrical guitar.

The foregoing illustrates only a very few embodiments of this invention. For example, in the embodiment of the electrical guitar of this invention described previously with regard to FIGS. 1 to 4, desired one, two or three of the pair of the mixer 45 and the jack 46, the jack 43, the pair of the mixer 47 and the jack 48 and the jack 44 may be omitted. Further, it is possible to provide the mixers 45 and 47 in an electrical sound signal processing circuit separately of the electrical guitar 1 instead of providing them in the body 7. Also, in the embodiment of the electrical guitar of this invention shown in FIGS. 5 to 7, the mixer 65 may be provided in an electrical sound signal processing circuit provided separately of the guitar 1. In the foregoing, magnetic head type transducers are used as the electromechanical transducers, but may also be of the electrostatic head type. In such a case, the strings need not be magnetic. Moreover, the foregoing has described the embodiments of the present invention as applied to the electrical guitar but it should be understood that the invention is also applicable electrical string-instruments similar to the electrical guitar.

It will be apparent that many modifications and variations may be effected without departing from the scope of novel concepts of this invention.

I claim as my invention:

1. An electrical string-instrument comprising:

N conductive strings $A_1, A_2, \ldots A_N$;

a support member having a major surface including a string receiving surface and stretching the strings $A_1$ to $A_N$ in opposing relation thereto to extend in substantially the same plane in parallel relation to one another;

a plurality of conductive frets disposed on the string receiving surface, which frets are sequentially disposed in the direction of extension of the strings $A_1$ to $A_N$ to extend in the direction perpendicular thereto;

electromechanical transducer means $C_1, C_2, \ldots C_N$ disposed in the area other than the string receiving area in the area opposite to the strings $A_1$ to $A_N$ on the major surface of the support member for converting mechanical vibrations of the strings $A_1, A_2, \ldots A_N$ into corresponding electrical signals $E_1, E_2, \ldots E_N$, respectively;

magnetic field generating means for generating a constant magnetic field to cover therewith the strings $A_1$ to $A_N$;

an electrical circuit for producing feedback signals $M_1, M_2, \ldots M_N$ based on the electrical signals $E_1, E_2, \ldots E_N$ respectively derived from the electromechanical transducer means $C_1, C_2, \ldots C_N$; and feedback signal supply means for supplying the feedback signals $M_1, M_2, \ldots M_N$ to flow feedback currents $I_1, I_2, \ldots I_N$ in those of the strings $A_1, A_2, \ldots A_N$ placed in the constant magnetic field emanating from the magnetic field generating means.

2. An electrical string-instrument according to claim 1, wherein there is provided, in the area other than the string receiving area opposite to the strings $A_1$ to $A_N$, electromechanical transducer means common to the strings $A_1$ to $A_N$ for converting the mechanical vibrations thereof into corresponding electrical signals.

3. An electrical string-instrument according to claim 2, which further includes means for combining the electrical signals $E_1, E_2, \ldots E_N$ from the electromechanical transducer means $C_1, C_2, \ldots C_N$ with the electrical signal from the common electromechanical transducer means to provide a composite signal.

* * * * *